United States Patent [19]

Schumacher et al.

[11] 4,051,947

[45] Oct. 4, 1977

[54] TRANSFER APPARATUS FOR CIGARETTES OR THE LIKE

[75] Inventors: Peter Schumacher; Helmut Niemann, both of Hamburg, Germany

[73] Assignee: Hauni-Werke Korber & Co. KG, Hamburg, Germany

[21] Appl. No.: 735,084

[22] Filed: Oct. 22, 1976

[30] Foreign Application Priority Data

Nov. 5, 1975 Germany ..... 2549512

[51] Int. Cl.[2] ..... B65G 47/22

[52] U.S. Cl. ..... 198/478; 198/689; 198/792; 198/800

[58] Field of Search ..... 198/377, 476, 478, 480, 198/689, 792, 797, 800

[56] References Cited

U.S. PATENT DOCUMENTS

| | | | |
|---|---|---|---|
| 3,303,926 | 2/1967 | Pohl | 198/478 |
| 3,521,513 | 7/1970 | Gomann et al. | 198/480 X |
| 3,567,011 | 3/1971 | Pinkham | 198/478 |
| 3,952,865 | 4/1976 | Rudszinat et al. | 198/377 |

*Primary Examiner*—Evon C. Blunk
*Assistant Examiner*—James L. Rowland
*Attorney, Agent, or Firm*—Peter K. Kontler

[57] ABSTRACT

Apparatus for converting a file of coaxial cigarettes into one or more rows of parallel cigarettes has a fixed sun gear which is coaxial with a driven rotary planet carrier for several equidistant groups of coaxial first and second pinions. The sun gear meshes with a first intermediate gear which is rotatable in the carrier and further meshes with the internal teeth of a ring gear which is coaxial with and rotatable relative to the carrier. The ring gear has first and second annuli of external teeth which respectively mesh with the first and second pinions. The first pinions are rigid with inclined crank arms for turnable cigarette holders which are coupled to the respective second pinions by universal joints. Successive holders receive successive cigarettes or pairs of cigarettes of the file at a first station where the holders are nearest to the axis of the carrier and move at a maximum tangential speed. The transfer of cigarettes into successive flutes of a rotary drum takes place at a second station where the holders are located at a maximum distance from the axis of the carrier and travel at a minimum tangential speed. The second pinions and the respective universal joints insure that the orientation of holders remains unchanged during transport of cigarettes from the first to the second station.

11 Claims, 3 Drawing Figures

3
3b
52
57
64
49
Z
A
II
II
16
22
B
68

TRANSFER APPARATUS FOR CIGARETTES OR THE LIKE

BACKGROUND OF THE INVENTION

The present invention relates to transfer apparatus for rod-shaped articles, and more particularly, to improvements in apparatus which can convert a file of aligned rod-shaped articles into one or more rows of parallel articles or vice versa. Still more particularly, the invention relates to improvements in apparatus which can accept cigarettes or analogous rod-shaped articles directly from the discharge end of a maker even if the maker discharges articles at a very high speed, e.g., 4,000 or more articles per minute. Rod-shaped articles which can be manipulated in the apparatus of the present invention, either singly or in groups of two or more, include plain or filter tipped cigarettes, cigars and cigarillos as well as simple or composite filter rod sections of unit length or multiple unit length. For the sake of simplicity, the invention will be described in connection with the manipulation of plain cigarettes.

Plain cigarettes are produced in machines (called makers) wherein a continuous rod-like tobacco filler is draped into a web of cigarette paper to form therewith a continuous cigarette rod which severed by a cutoff to yield a single file of coaxial plain cigarettes which move at an elevated speed, especially in a modern maker which can turn out in excess of 70 cigarettes per second. As a rule, the single file of cigarettes is converted into one or more rows wherein the cigarettes move sideways. This is advantageous and practical, not only when the cigarettes are transported to packing machines but also for the purposes of transport into storage (e.g., in customary chargers or trays) or directly into a filter cigarette making machine. In most instances, plain cigarettes which issue from the maker are delivered to a filter cigarette making machine. This entails a change in the direction of movement from axial or lengthwise to sidewise movement. Furthermore, the speed of cigarettes which form one or more rows and move sideways is only a fraction of the speed of cigarettes which move axially, and the cigarettes which form the row or rows are closely adjacent to each other. The apparatus which converts the file of cigarettes into one or more rows must be designed with a view to insure that the cigarettes are treated gently, not only for the purpose of avoiding damage to and/or deformation of their wrappers but also to avoid escape of appreciable quantities of tabacco at the ends. In other words, the accelerating and/or decelerating forces which act upon the cigarettes should be reduced as much as possible.

U.S. Pat. Nos. 3,303,926 (Pohl) and 3,567,011 (Pinkham)disclose transfer apparatus which are used for the above-outlined purposes. The principle of operation of the apparatus of Pinkham is similar to that of the apparatus of Pohl; each of these apparatus employs a first or main planetary having a stationary sun gear which meshes with several planet pinions mounted on a carrier and supporting eccentrically mounted holders for cigarettes. The pinions (each having a diameter equal to the radius of the sun gear) roll along the sun gear in response to rotation of the carrier whereby each revolution of the carrier entails three revolutions of each holder (in the same direction) about the axis of the respective pinion. This is due to the fact that, insofar as the holders are concerned, the rotary movement of the planet carrier is added to or superimposed upon the rotary movement of planet pinions, i.e., the angular speed of each holder is three times the angular speed of the planet carrier. Due to the just outlined kinematic relationship, each holder travels along an epicycloidal path. The tangential speed of holders reaches a maximum value when such holders are located at a maximum distance from the axis of the planet carrier, and vice versa.

Additional planetaries are provided to insure that the orientation of holders during travel along the epicycloidal path remains unchanged. The planet pinions of the first planetary constitute planets carriers of the additional planetaries. The planet pinions of the additional planetaries roll along sun gears which are secured to the planet carrier of the first mentioned planetary.

The just described conventional transfer apparatus exhibit many advantages, especially owing to continuous movement as a result of superimposed simple angular movements. However, they cannot be installed in or associated with modern high-speed makers having an output in the range of 70 cigarettes per second. In such makers, and assuming that each holder carries two cigarettes at a time as well that the transfer apparatus comprises six holders, the planet carrier of the main planetary would have to complete 188 revolutions and each holder would have to complete 564 revolutions per minute. The cigarettes would be subjected to accelerating and decelerating forces of such magnitude that each thereof would lose substantial quantities of tabacco at one or both ends. Moreover, conventional apparatus are incapable of reducing the distance between neighboring cigarettes to the extent which is necessary for direct transfer of cigarettes into a processing machine, e.g., a filter cigarette maker. Therefore, such transfer apparatus must deliver cigarettes to a further apparatus which reduces the spacing of neighboring cigarettes to a value which is acceptable for introduction of cigarettes into the processing machine.

Another drawback of conventional transfer apparatus is that they must be assembled of sturdy, bulky and expensive components which must withstand pronounced stresses. The inordinately large number of planetaries also contributes to initial and maintenance cost, and the large number of mating gears produces considerable noise, especially when the apparatus is operated at an elevated speed.

SUMMARY OF THE INVENTION

An object of the invention is to provide a transfer apparatus for cigarettes or analogous rod-shaped articles which can convert a file of coaxial articles into one or more rows of parallel articles or vice versa in such a way that the spacing of neighboring parallel articles is satisfactory for immediate introduction of articles into a further processing unit.

Another object of the invention is to provide a transfer apparatus which can accept and manipulate the output of a modern high-speed maker, which comprises a small number of components, and which generates less noise than heretofore known apparatus.

A further object of the invention is to provide a transfer apparatus which is capable of processing large quantities of cigarettes per unit of time without appreciable losses in tobacco, i.e., with acceptable acceleration and deceleration of articles during transport from a maker.

An additional object of the invention is to provide a transfer apparatus of the above outlined character which can be mounted in or connected with existing cigarette makers.

The invention is embodied in an apparatus for transferring cigarettes or analogous rod-shaped articles between a first path along which the articles move lengthwise and a second path along which the articles move sideways. The apparatus comprises a first planetary having a planet carrier which is rotatable about a fixed axis and a first planet pinion which is rotatably mounted in the carrier, a crank which is rotatable with and has a portion remote from the axis of the first pinion, an article holder or pick-up means which is turnably supported by the aforementioned portion of the crank, a second planetary having a second planet pinion which is coaxial with and is rotatable relative to the first pinion, means for articulately coupling the second pinion with the article holder so that the angular position of the holder relative to the second pinion remains unchanged, means for rotating the carrier in a predetermined direction to thereby orbit the pinions about the fixed axis, means for rotating the first pinion through one revolution counter to the predetermined direction in response to each revolution of the carrier and for thereby orbiting the holder about the axis of the first pinion so that the holder travels along an endless third path having a first portion where the tangential speed of the holder reaches a maximum value and which is nearest to the fixed axis and a second portion where the tangential speed of the holder is reduced to a minimum value and which is located at a maximum distance from the fixed axis, and means for rotating the second pinion in response to rotation of the carrier in a direction and at a speed such that the orientation of the holder remains unchanged while the pinions orbit about the fixed axis and the aforementioned portion of the crank orbits about the common axis of the pinions.

The holder can accept articles in the first portion of the third path to deliver such articles to a suitable conveyor in the second portion of the third path, or vice versa.

The novel features which are considered as characteristic of the invention are set forth in particular in the appended claims. The improved transfer apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

The transfer apparatus comprises two superimposed planetaries which have a common sun gear and each of which preferably comprises several planet pinions. There are two planet pinions for each cigarette holder, and each holder is designed to transport two cigarettes at a time.

Figure 3:
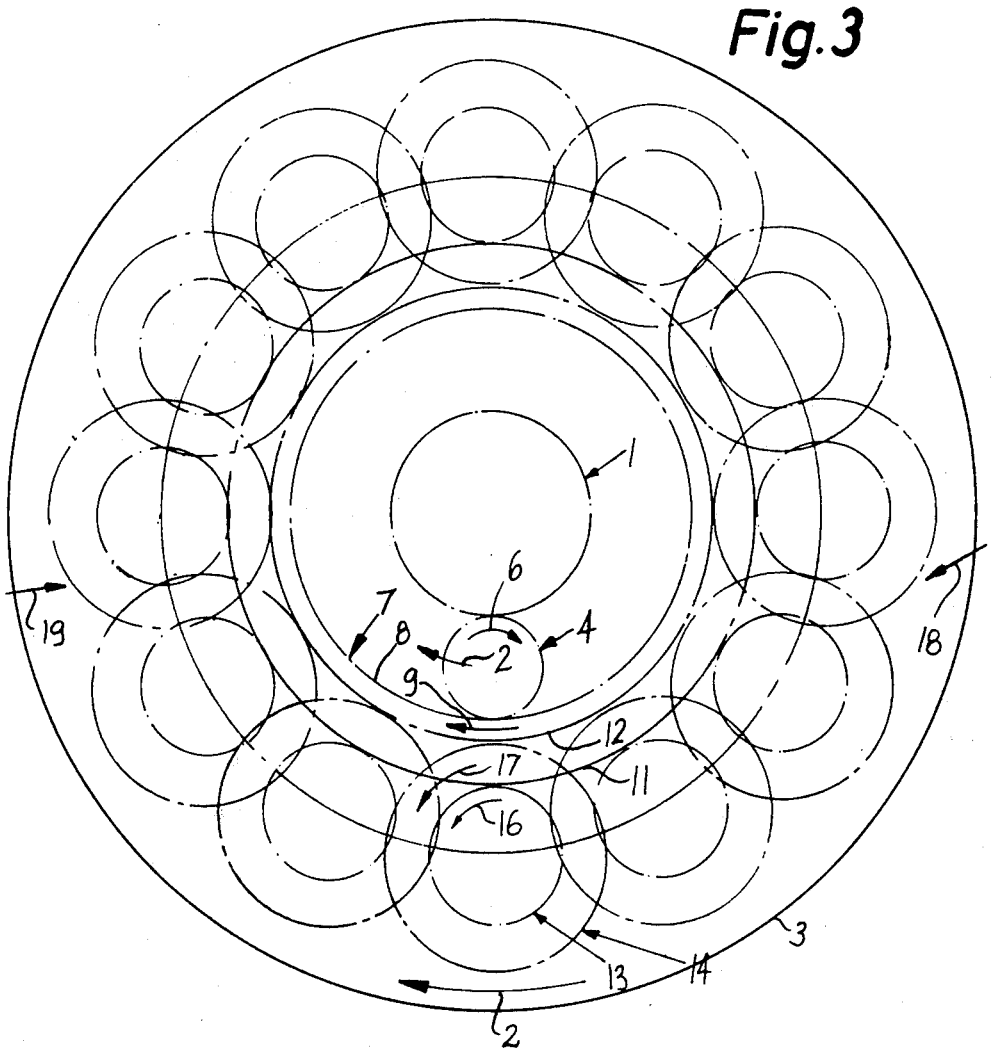
FIG. 3 is a schematic front elevational view of planetaries in the transfer apparatus of FIG. 1.

Referring first to FIG. 3, the transfer apparatus has a single stationary sun gear 1 which is in mesh with an intermediate gear 4. The latter is mounted on a planet carrier 3 which is driven to rotate in the direction indicated by arrow 2 whereby the intermediate gear 4 rotates in the direction indicated by arrow 6. A second intermediate gear 7 is a ring gear whose internal teeth 8 mate with the teeth of the intermediate gear 4. The gear 7 is coaxial with the sun gear 1 and the direction of its rotation is indicated by the arrow 9. The intermediate gear 7 has two annuli of external teeth including a larger-diameter annulus 11 and a smaller-diameter annulus 12. The annulus 11 of teeth on the gear 7 mates with twelve first planet pinions 13, and the annulus 12 of teeth mates with twelve second planet pinions 14. Each pinion 13 is coaxial with a pinion 14, and all of these pinions are rotatably mounted on the carrier 3. The directions in which the pinions 13 and 14 rotate are respectively indicated by arrows 16 and 17. The neighboring (larger-diameter) pinions 14 are disposed in two parallel planes, and the axial length of teeth of annulus 12 is sufficient to insure that all of the pinions 14 can mesh with this annulus. Such staggered mounting of pinions 14 is necessary because the neighboring pinions 14 overlap each other.

The ratios of various gears in the transfer apparatus of FIG. 3 are as follows: A 2:1 ratio is established between the sun gear 1 and the intermediate gear 4. The ratio between the intermediate gear 4 and the internal annulus 8 of the intermediate gear 7 is 1:4. The ratio of annulus 11 to a planet pinion 13 is 4:1, and the ratio of annulus 12 to a planet pinion 14 is 2:1.

The parts 1, 3, 4, 7 (with its annulus 11) and 13 constitute a first planetary 18. The parts 1, 3, 4, 7 (with its annulus 12) and 14 constitute a second planetary 19.

Figure 1:
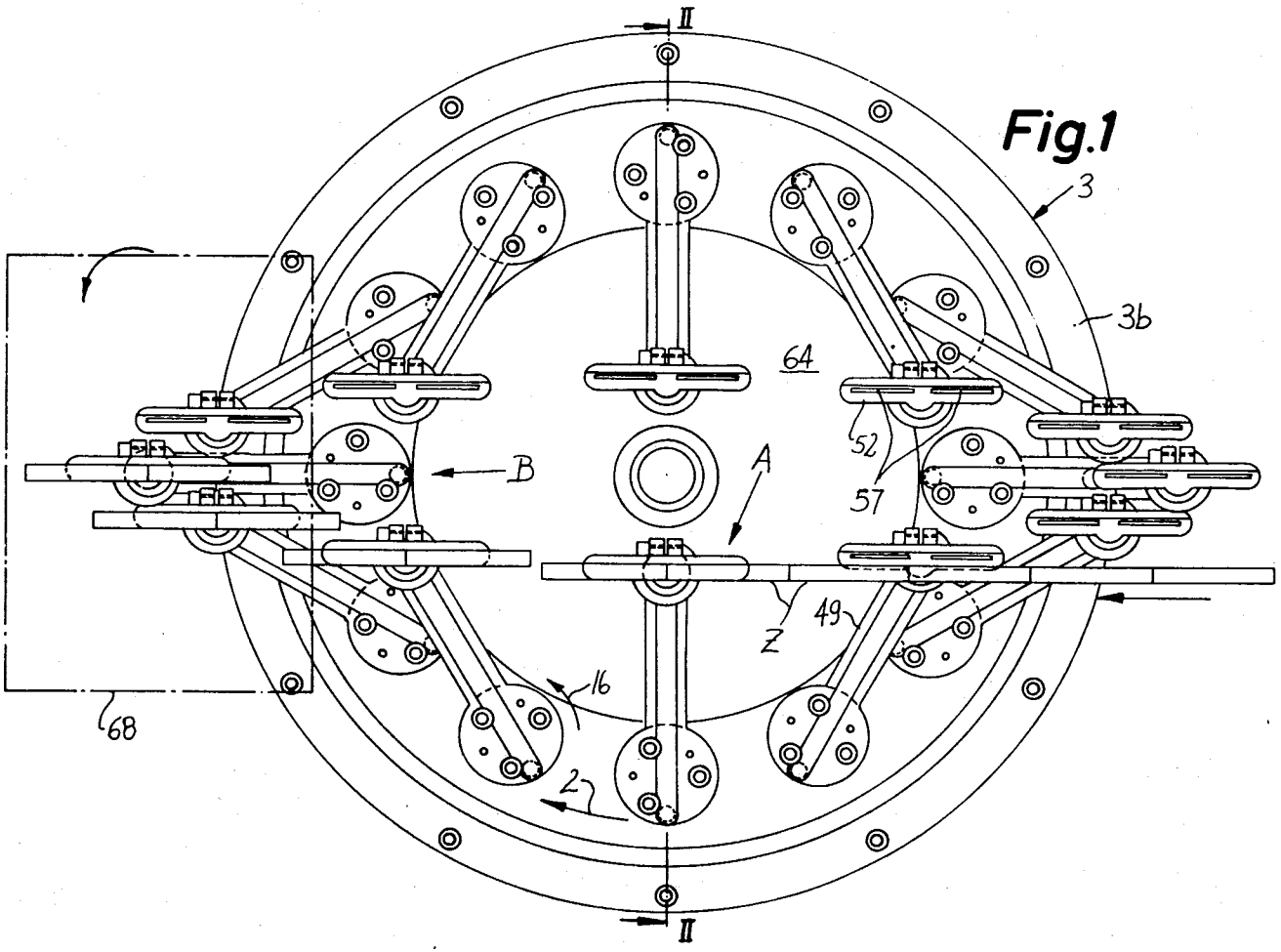
FIG. 1 is a schematic front elevational view of a transfer apparatus which embodies the invention.
Figure 2:
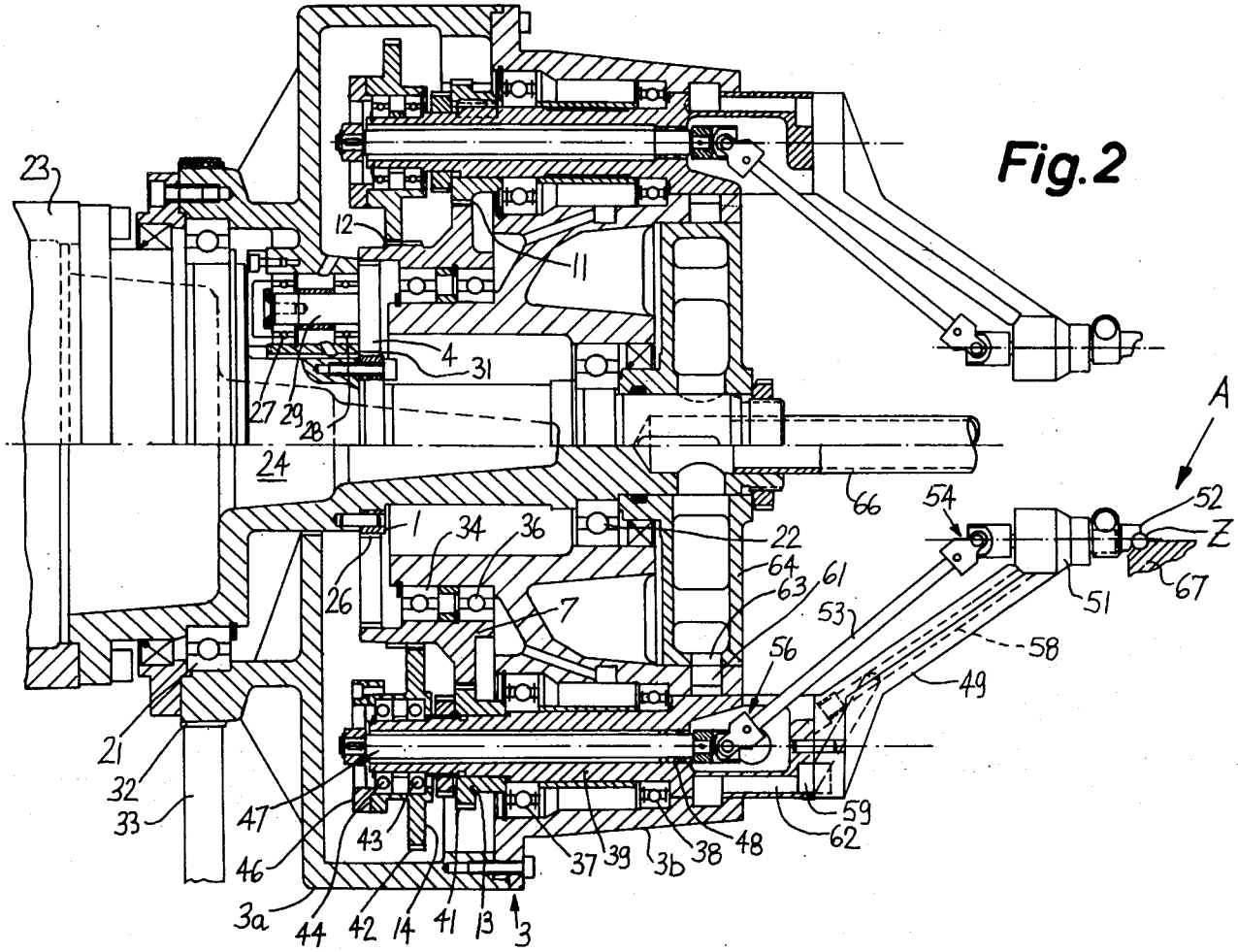
FIG. 2 is a sectional view as seen in the direction of arrows from the line II—II of FIG. 1.

The details of a transfer apparatus which embodies the planetaries 18 and 19 are shown in FIGS. 1 and 2. The planet carrier 3 comprises a housing which is assembled of two sections **3*a* and 3*b*. These sections are rotatably mounted on a shaft 24 by way of antifriction ball bearings 21 and 22. The shaft 24 is fixedly mounted in a stationary frame member 23 and is rigid with the sun gear 1 whose teeth are indicated at 26. The intermediate gear 4 is mounted in cantilever fashion in antifriction ball bearings 27 and 28 which are installed in the section 3*a* of the planet carrier 3. The shaft of the intermediate gear 4 is shown at 29 and its annulus of teeth at 31. The section 3*a* of the planet carrier 3 comprises a toothed pulley 32 which is adjacent to the ball bearing 21 and is driven by a toothed belt 33 constituting a means for transmitting torque from the main prime mover (not shown) of the maker The intermediate gear 7 is rotatable in antifriction ball bearings 34 and 36 which are installed in the section 3*b* of the planet carrier 3. The associated planet pinions 13 and 14 have common sleeves 39 which are rotatable in antifriction ball bearings 37 and 38 installed in the section 3*b*. The external teeth of the planet pinions 13 and 14 are respectively shown at 41 and 42. The planet pinions 13 are rigid with the respective sleeves 39. The planet pinions 14 are rotatable on antifriction ball bearings 43 and 44 which are mounted on the respective sleeves 39. Each pinion 14 is coupled to a shaft 47 through the medium of a disk 46, and each shaft 47 is rotatable in a needle bearing 48 which is installed in the respective sleeve 39. Each sleeve 39 has an end portion which is remote from the respective planet pinions 13 and 14, and such end portions are rigid with crank arms 49 having end portions or heads 51 for turnable holders 52. Each holder 52 can transport two coaxial plain cigarettes Z at a time. The length of each crank arm 49 is the same and is selected in such a way that the holders 52 are located outside of the pitch circles of the respective planet pinions 13. Each holder 52 is articulately connected with a Cardanic joint or an analogous universal joint including two pivots 54, 56 and a connecting rod 53 therebetween. Each pivot 56 is mounted at one end of the associated shaft 47, i.e., each holder 52 is turnable by the respective planet pinion 14.**

The means for attracting cigarettes Z to the respective holders 52 comprises elongated slot-shaped suction ports 57 (see FIG. 1) which are machined into the heads 52 and communicate with grooves (not shown) in the respective heads 51. Such grooves communicate with channels or bores 58 which are machined into the respective arms 49, and such channels communicate with ports 59, 61 and bores 62 in the respective sleeves 39. The ports 61 can communicate with an arcuate groove 63 which is machined into the periphery of a valve plate 64 on the shaft 24. The shaft 24 has a bore which is connected with one end of a conduit 66 serving to connect the groove 63 with a fan or another suitable suction generating device, not shown.

The maker includes a guide member 67 which conveys a single file of cigarettes Z along a first path and on to a transfer station or pick-up station A where the cigarettes are accepted by successive holders 52. The cigarettes Z of the single file in the guide 67 move at right angles to the plane of FIG. 2. The means for receiving pairs of coaxial cigarettes Z from successive holders 52 at a second transfer station or delivery station B comprises a rotary drum-shaped conveyor 68 having parallel peripheral flutes which define a second path and each of which is long enough to receive two coaxial cigarettes Z. Each cigarette Z is assumed to be 60 millimeters long. Thus, the combined length of a group of two coaxial cigarettes Z which are accepted by an oncoming holder 52 at the first transfer station A is 120 millimeters. At the transfer station A, the tangential speed of holders 52 is preferably slightly higher than the speed of lengthwise movement of cigarettes Z in the guide member 67 of the maker. The maker is assumed to be a cigarette rod making machine can turn out up to and in excess of 70 cigarettes Z per second. The spacing between neighboring cigarettes Z in each of the two rows which are formed in the flutes of the conveyor 68 is assumed to be $6\pi$.

The operation:

The belt 33 drives the planet carrier 3 (arrow 2) through the medium of the pulley 32. The planet carrier 3 causes the intermediate gear 4 and the planet pinions 13, 14 to orbit about the common axis of the shaft 24 and sun gear 1. The sun gear 1 causes the gear 4 to rotate about its own axis (arrow 6) whereby the gear 4 rotates the gear 7 in the direction indicated by arrow 9. The planet pinions 13 and 14 roll along the respective teeth 11 and 12 and are thus caused to rotate in the directions indicated by arrows 16 and 17. During each revolution of the planet carrier 3, each crank arm 49 and the associated holder 52 performs two revolutions with respect to the planet carrier; however, and since the direction of rotation of the planet carrier (arrow 2) is counter to the direction of rotation (arror 16) of the planet pinions 13, each crank arm 49 actually performs a single revolution because the revolution which is performed by the carrier is subtracted from the revolutions of the crank arms. The angular speed of the carrier 3 is the same as that of the pinions 13; however, these parts rotate in opposite directions.

Each planet pinion 14 performs a revolution with respect to the planet carrier 3 during each revolution of the planet carrier. However, since the direction of rotation of the planet carrier 3 (arrow 2) is counter to the direction of rotation of planet pinions 14 (arrow 17), the angular position of each planet pinion 14 with respect to the planets carrier 3 remains unchanged. Since the holders 52 cannot rotate relative to the associated planet pinions 14, the angular position of each holder with respect to the carrier 3 also remains unchanged. Thus, the holders 52 travel along an endless (third) path but their orientation remains unchanged. The tangential speed of holders 52 reaches a maximum value when the axes of such holders are located at a minimum distance from the common axis of the shaft 24, sun gear 1 and planet carrier 3. Inversely, the tangential speed of the holders 52 is reduced to a minimum value when their axes are located at a maximum distance from the axis of the planet carrier 3.

The guide member 67 delivers successive cigarettes Z of the single file tangentially of the path of oncoming holders 52, and each holder 52 accepts a pair of coaxial cigarettes Z which adhere to the holder because the ports 57 are then in communication with the suction generating device by way of the corresponding crank arm 49 and valve plate 64. Since the tangential speed of holders 52 preferably exceeds the speed of lengthwise movement of cigarettes Z in the guide member 67, each pair of cigarettes which are accepted by a holder 52 moves forwardly of and away from the next-following cigarette in the guide member 67. This is desirable and advantageous because such mode of driving the planet carrier 3 insures that cigarettes Z in neighboring holders 52 cannot interfere with each other during travel between the stations A and B. The spacing between the pairs of cigarettes Z in neighboring holders 52 decreases continuously and gradually during transport from the station A to the station B (such spacing is measured in the axial direction of cigarettes), and this reduction of spacing entails a proportional reduction of the speed of cigarettes at the time they reach the conveyor 68 at the station B. The ports 57 of a holder 52 which reaches the station B are sealed from the suction conduit 66 in a manner well known in the art so that the suction ports (not shown) in the flutes of the conveyor 68 can effect the transfer of successive pairs of cigarettes at the station B. The freshly emptied holders 52 begin to move back toward the station A and the cigarettes in the flutes of the conveyor 68 form two rows wherein the cigarettes travel sideways.

Since the crank arms 49 are inclined and offset with respect to the corresponding pinions 13, they can bypass each other while the holders 52 travel along an endless path a first portion of which (at A) is nearest to the axis of the shaft 24 (this is the location where the tangential speed of a holder 52 reaches a maximum value) and a second portion of which (at B) is located at a maximum distance from the axis of shaft 24 (at this locus, the tangential speed of the holders 52 reaches a minimum value).

The ratio 2:1 of the angular speeds of pinions 13 and 14 insures that the orientation of holders 52 remains unchanged during each stage of travel along the aforementioned endless path; this is shown in FIG. 1.

The feature that the holders 52 are located outside of the pitch circles of the corresponding pinions 13 insures that the spacing between the pairs of cigarettes at the station B (as considered in the axial direction of the cigarettes) is only a small fraction of the spacing of successive pairs of cigarettes at the station A. The aforediscussed mounting of crank arms 49 on the associated pinions 13 further insures that the carrier 3 can support a large number of holders 52 in a small area; as mentioned above, the crank arms 49 overlap each other during certain stages of movement along the endless path.

The just described transfer apparatus constitutes a basic departure from previously known apparatus because it can insure satisfactory orientation of holders as well as the transfer of large numbers of articles per unit of time without resorting to a disproportionately large number of gears. In fact, the second planetary of the improved apparatus comprises only one element (the pinions 14) which is not common to the first planetary 18. The two planetaries share the sun gear 1, the carrier 3, and the intermediate gears 3 and 7. The gears 3 and 7 cause the pinions 13 to rotate about their own axes when the carrier 3 is driven by the belt 33 and pulley 32, and the teeth 12 of the gear 7 cause the pinions 14 to rotate receive to the pinions 13 so as to insure that the orientation of the holders 52 remains unchanged.

An importate advantage of the improved transfer apparatus is that, in view of the aforediscussed transmission ratios, each holder actually performs a single revolution during each revolution of the planet carrier. This insures a steady and accurately reproducible transfer of cigarettes from the station A to the station B. In the region between these stations, the path for the holders 52 curves in a single direction and the curvature of such path increases gradually in a direction from the station A toward the station B. This insures that the cigarettes are not subjected to abruptly increasing or decreasing accelerating forces and that such forces are relatively small so that the transfer takes place without any or with negligible losses of tobacco at the free ends of cigarettes which travel with the holders 52. The spacing between successive pairs of cigarettes (as considered in the axial direction of cigarettes) decreases steadily during travel with the holders 52 while the movement in the axial direction (at the station A) is gradually converted into a sidewise movement of cigarettes.

Another important advantage of the improved transfer apparatus is that its parts produce little noise, even when the planet carrier 3 is driven at a maximum speed (such as is necessary to process the entire output of a maker which turns out in excess of 70 cigarettes per second). This is attributed to the fact that, even though the transfer apparatus employs two planetaries, the overall number of moving parts is only a small fraction of the number of moving parts in conventional transfer apparatus.

Still further, the improved apparatus can be readily modified to enable the holders 52 to transport cigarettes at different speeds and/or to change the spacing between successive pairs of cigarettes during travel between the stations A and B within a wide range.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. Apparatus for transferring cigarettes or analogous rod-shaped articles between first and second paths along which the articles respectively move lengthwise and sideways, comprising a planet carrier rotatable about a first axis; a first pinion rotatably supported by said carrier; a crank rotatable with and having a portion remote from the axis of said pinion; an article holder turnably supported by said portion of said crank; a second pinion coaxial with and rotatable relative to said first pinion; means for articulately coupling said second pinion with said holder so that the angular position of said holder with respect to said second pinion remains unchanged when the latter rotates about the axis of said first pinion; means for rotating said carrier in a predetermined direction; means for rotating said first pinion through one revolution counter to said direction in response to each revolution of said carrier and for thereby orbiting said holder about the axis of said first pinion so that said holder travels along an endless third path having a first portion at a minimum distance from said first axis and nearer to said first path and a second portion at a maximum distance from said first axis and nearer to said second path, the tangential speed of said holder respectively reaching a maximum and a minimum value in said first and second portions of said third path; and means for rotating said second pinion in response to rotation of said carrier in a direction and at a speed such that the orientation of said holder remains unchanged while said pinions orbit about said first axis.

2. Apparatus as defined in claim 1, further comprising a fixed sun gear coaxial with said carrier, and means for rotating said first pinion comprising a first intermediate gear rotatably supported by said carrier and meshing with said sun gear and a second intermediate gear coaxial with and rotatably relative to said carrier, said second intermediate gear having an annulus of internal teeth meshing with said first intermediate gear and an annulus of external teeth meshing with said first pinion.

3. Apparatus as defined in claim 2, wherein said second intermediate gear has a second annulus of external teeth meshing with and constituting said means for rotating said second pinion.

4. Apparatus as defined in claim 3, wherein the ratio of angular speeds of said first and second pinions is 2:1.

5. Apparatus as defined in claim 1, wherein the distance between said holder and the axis of said first pinion exceeds the pitch circle of said first pinion.

6. Apparatus as defined in claim 1, wherein said crank is rigid with said first pinion.

7. Apparatus as defined in claim 1, wherein said coupling means comprises a universal joint.

8. Apparatus as defined in claim 1, wherein said holder comprises means for attracting at least one article by suction, at least during travel of said holder between said first and second portions of said third path.

9. Apparatus as defined in claim 1, further comprising a fixed sun gear coaxial with said carrier, said means for rotating said pinions comprising a first intermediate gear in mesh with said pinions and a second intermediate gear in mesh with said sun gear and said first intermediate gear.

10. Apparatus as defined in claim 9, wherein the ratio of said sun gear to said second intermediate gear is 2:1, the ratio of said first intermediate gear to said second intermediate gear is 4:1, the ratio of said first intermediate gear to said first pinion is 4:1, and the ratio of said first intermediate gear to said second pinion is 2:1.

11. Apparatus as defined in claim 1, further comprising at least one additional first pinion rotatable on said carrier, at least one additional second pinion coaxial with and rotatable relative to said additional first pinion, an additional crank mounted on said additional first pinion, an additional holder turnably mounted in said additional crank, and additional coupling means connecting said additional second pinion with said additional holder.

* * * * *